US010363583B2

(12) United States Patent
Siczek et al.

(10) Patent No.: US 10,363,583 B2
(45) Date of Patent: Jul. 30, 2019

(54) METHOD AND APPARATUS FOR PARTICULATE CONTROL FROM MOVING WEBS

(71) Applicant: The Procter & Gamble Company, Cincinnati, OH (US)

(72) Inventors: Pawel M. Siczek, Liberty Township, OH (US); Gustav Andre Mellin, Amberly Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 75 days.

(21) Appl. No.: 15/826,903

(22) Filed: Nov. 30, 2017

(65) Prior Publication Data

US 2019/0160496 A1 May 30, 2019

(51) Int. Cl.

| | |
|---|---|
| ***D21F 1/24*** | (2006.01) |
| ***B08B 1/02*** | (2006.01) |
| ***B08B 5/04*** | (2006.01) |
| ***B08B 5/02*** | (2006.01) |

(52) U.S. Cl.

CPC ..... *B08B 1/02* (2013.01); *B08B 5/026* (2013.01); *B08B 5/046* (2013.01); *B65H 2301/5115* (2013.01)

(58) Field of Classification Search

USPC ..... 162/199, 272

See application file for complete search history.

(56) References Cited

U.S. PATENT DOCUMENTS

| | | | | |
|---|---|---|---|---|
| 4,348,840 | A | 9/1982 | Strader et al. | |
| 4,753,665 | A | 6/1988 | Fahey | |
| 5,783,044 | A * | 7/1998 | Schneider | D21F 1/325 134/148 |
| 5,800,679 | A * | 9/1998 | Lindstrom | B08B 5/026 134/64 R |
| 6,146,630 | A | 11/2000 | Tsubota et al. | |
| 6,176,898 | B1 * | 1/2001 | Courtney | B01D 45/12 162/272 |
| 6,328,852 | B1 * | 12/2001 | McGary | B65H 23/24 162/199 |
| 6,749,723 | B2 * | 6/2004 | Linden | B65H 18/02 162/118 |

(Continued)

FOREIGN PATENT DOCUMENTS

| | | |
|---|---|---|
| CN | 2832985 U | 11/2006 |
| CN | 200992788 U | 12/2007 |

(Continued)

*Primary Examiner* — Mark Halpern

(74) *Attorney, Agent, or Firm* — Andrew J. Hagerty; Sarah M. DeCristofaro

(57) ABSTRACT

A method and apparatus for removing particles, such as dust, generated by a moving web is disclosed. A dust control platform is positioned adjacent to a traversing web to catch the particles generated by the web. The particles pass through one or more apertures defined by an accumulation surface. The particles pass through the accumulation surface and into an accumulation chamber. The accumulation chamber may include a sweeping device or other device that may be used to transfer the accumulated particles to a collection chamber. The collection chamber is connected to a vacuum source. Vacuum is applied to the collection chamber by the vacuum source such that the particles are removed from the collection chamber.

6 Claims, 8 Drawing Sheets

(56) References Cited

U.S. PATENT DOCUMENTS

| | | | | |
|---|---|---|---|---|
| 10,023,996 | B1 * | 7/2018 | Kelyman | D21G 9/00 |
| 2008/0142180 | A1 * | 6/2008 | Savolainen | D21F 1/32<br>162/199 |
| 2013/0149089 | A1 | 6/2013 | Harms, Jr. et al. | |

FOREIGN PATENT DOCUMENTS

| | | |
|---|---|---|
| CN | 202227650 U | 5/2012 |
| CN | 203448179 U | 2/2014 |
| CN | 104164961 | 11/2014 |
| CN | 105946023 | 5/2016 |
| CN | 105946021 | 9/2016 |
| CN | 106150148 | 11/2016 |
| DE | 102008024965 | 7/2010 |
| JP | 7283181 | 10/1995 |
| JP | 2530755 | 9/1996 |
| JP | 11051645 | 2/1999 |
| JP | 3072552 | 7/2000 |
| JP | 3584711 | 11/2004 |
| JP | 2006152623 | 6/2006 |
| JP | 3813388 | 8/2006 |
| KR | 101245757 | 3/2013 |
| VN | 47334 | 6/2016 |
| WO | WO 200261219 | 8/2002 |
| WO | WO 201797235 | 6/2017 |
| WO | WO 201797237 | 6/2017 |
| WO | WO 201797239 | 6/2017 |
| WO | WO 201797240 | 6/2017 |
| WO | WO 201797241 | 6/2017 |

* cited by examiner

METHOD AND APPARATUS FOR PARTICULATE CONTROL FROM MOVING WEBS

FIELD

The present disclosure relates to methods and apparatuses for controlling particulates, such as dust, from a moving web, including nonwoven and paper webs.

BACKGROUND

Converting lines, including paper machines and particularly machines making tissue paper such as toilet tissue, facial tissue, and paper towels, create substantial amounts of dust. Dust and other particulates get carried in the boundary layer of a moving web but gets dislodged when the web is disturbed or changes directions. Dislodged dust that accumulates on the machinery and surrounding surfaces can interfere with correct operation, lead to product quality problems in some circumstances, and can hinder or require maintenance. Additionally, dust that is transferred into the air can also represent a fire hazard, and its inhalation can cause health problems for workers.

Much effort has been directed to the development of dust hoods for vacuuming dust laden air from parts of such machines. However, such devices are themselves imperfect in operation and can require substantial power consumption as well as being a source of noise.

One problem with methods involving vacuum applied to the web surface is that the vacuum, in addition to removing airborne fibers can partially dislodge fibers in the web, creating loose or loosened fibers which then can become airborne downstream from the vacuum areas.

There is thus a continuing need for a method and apparatus for removing dust in a power-efficient, environmentally friendly manner.

SUMMARY

A method for controlling dust generated from a moving paper web is disclosed. The method includes: traversing a web in a machine direction; providing a dust control platform positioned adjacent the web, wherein the dust control platform comprises: an accumulation surface comprising a first surface and a second surface, wherein the accumulation surface comprises a plurality of apertures extending through the accumulation surface from the first surface to the second surface; an accumulation chamber positioned adjacent the second side of the accumulation surface, wherein the accumulation chamber comprises a first end portion and a second end portion; a collection chamber positioned adjacent the second end portion of the accumulation chamber; a vacuum source operatively connected to the collection chamber; a sweeping device positioned adjacent the first end portion of the accumulation chamber; wherein the dust generated by the moving web passes through the apertures of the accumulation surface of the dust control platform; accumulating the dust in the collection chamber; activating the sweeping device, wherein the sweeping device traverses along the accumulation chamber from the first end portion to the second end portion; depositing the dust that accumulated in the accumulation chamber in the collection chamber; and removing the dust from the collection chamber using a vacuum source.

In some embodiments, a method of controlling dust from a moving web may include: traversing a web in a machine direction, wherein the traversing web generates dust; providing a dust control platform positioned adjacent the web, wherein the dust control platform comprises: an accumulation surface, wherein the accumulation surface comprises a plurality of apertures; an accumulation chamber positioned adjacent the accumulation surface, wherein the accumulation chamber comprises a first end portion and a second end portion; a collection chamber positioned adjacent the second end portion of the accumulation chamber; a sweeping device positioned adjacent the first end portion of the accumulation chamber; wherein the dust generated by the traversing web passes through the apertures of the accumulation surface of the dust control platform; accumulating the dust in the collection chamber; activating the sweeping device, wherein the sweeping device traverses along the accumulation chamber from the first end portion to the second end portion; and depositing the dust that accumulated in the accumulation chamber to the collection chamber.

In some embodiments, a method of controlling dust from a moving web, the method may include: traversing a web in a machine direction, wherein the traversing web generates dust; providing a dust control platform positioned adjacent the web, wherein the dust control platform comprises: an accumulation surface, wherein the accumulation surface comprises a plurality of apertures extending through the accumulation surface, and wherein the accumulation surface comprises an external surface and an internal surface; an accumulation chamber positioned adjacent the accumulation surface, wherein the accumulation chamber comprises a first end portion and a second end portion; a collection chamber positioned adjacent the second end portion of the accumulation chamber; a plurality of vanes positioned adjacent the internal surface of the accumulation surface; a drive member operatively engaged with the plurality of vanes; wherein the dust generated by the traversing web passes through the apertures of the accumulation surface of the dust control platform; accumulating the dust in the collection chamber; activating the plurality of vanes such that the plurality of vanes are positioned in a closed configuration; activating a vacuum source operatively connected to the accumulation chamber; and removing the dust from the accumulation chamber.

DETAILED DESCRIPTION

Figure 1:
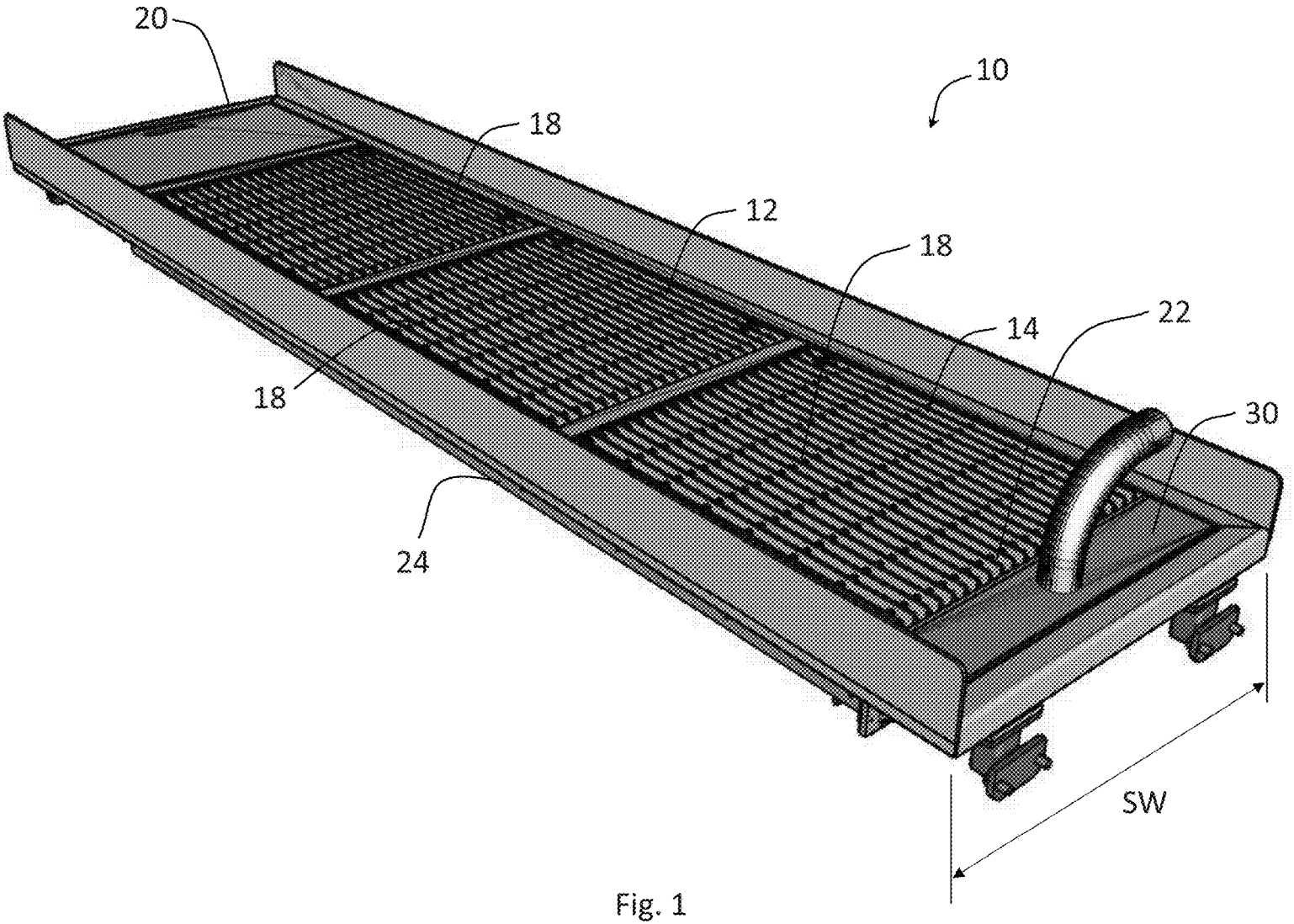
FIG. 1 is a perspective, top view of a dust control platform.

In a typical paper machine for making absorbent tissue, such as bath tissue, facial tissue, or paper towels there is a drying section in which the paper web is adhered to the surface of a rotating Yankee dryer and lead to a creping doctor blade. There, the web is creped off the Yankee dryer by the creping blade. The creped paper web can then be wound onto a reel, which is often referred to as a parent roll. At creping, and in other parts of the dry paper-making path, dust separates from the paper web. Part of this dust will be entrained in a boundary layer on each side of the web. This dust can become dislodged from the boundary layer and accumulate on the machinery, walking surfaces, and any other substantially horizontal surfaces. This accumulation can interfere with correct operation, lead to product quality problems, hinder maintenance, and may also present a fire hazard. Additionally, dust that is transferred into the air can also represent a fire hazard and can be breathed by workers.

Similar problems with respect to dust and particulate creation and its removal are observed also in the converting of such paper webs, as well as in the manufacture and converting of other webs like nonwovens and other webs made of filaments.

Current dust control solutions are based on continuous airflow to redirect and move dust into collection hoods. These dust hoods are expensive to continuously operate and the hoods are unable to remove all the dust. The remaining dust still causes the problems previously mentioned.

Accordingly, the method and apparatus will be described below primarily in its capacity for catching and extracting at least a portion of the dust generated by a moving paper web that accumulates on surfaces adjacent to the moving paper web.

The method and apparatus for controlling particles, such as dust, generated by a moving web includes positioning a dust control platform adjacent to a web that traverses in a machine direction. The dust control platform may include an accumulation surface. The accumulation surface may be any surface upon which dust may accumulate, for example, a substantially horizontal surface. The accumulation surface may include a plurality of apertures through which the dust passes. The dust passes through the accumulation surface into an accumulation chamber. The accumulation chamber is positioned adjacent the accumulation surface and contains the dust that accumulates therein. The dust may be continuously collected by the accumulation chamber. A collection chamber is positioned adjacent an end of the accumulation chamber. The dust may be moved from the accumulation chamber into the collection chamber. The dust may be moved by a sweeping device, such as a brush or fin. The collection chamber may be operatively connected to a vacuum source. The vacuum source may remove the dust from the collection chamber.

The web may be a nonwoven or paper web. In some embodiments, the nonwoven or paper web includes a web width. The web width may be greater than about 50 inches.

Figure 2:
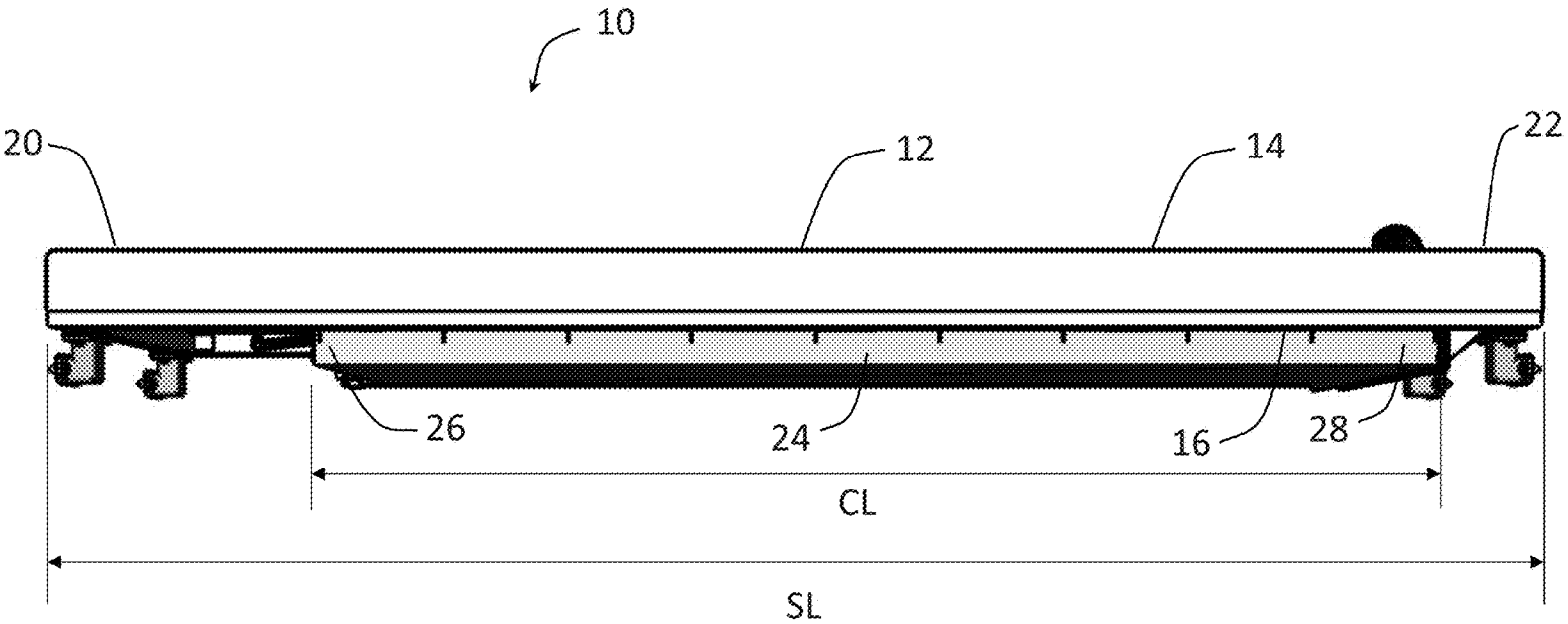
FIG. 2 is a side view of a dust control platform.
Figure 2A:
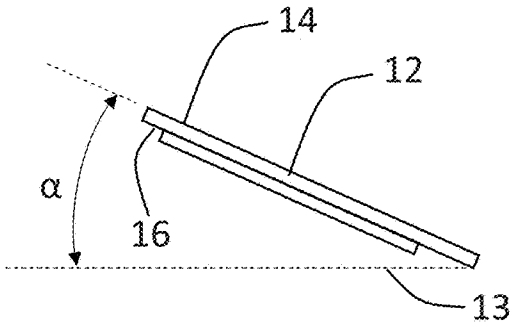
FIG. 2A is a schematic representation of the angle at which the dust control platform may be inclined.
Figure 3:
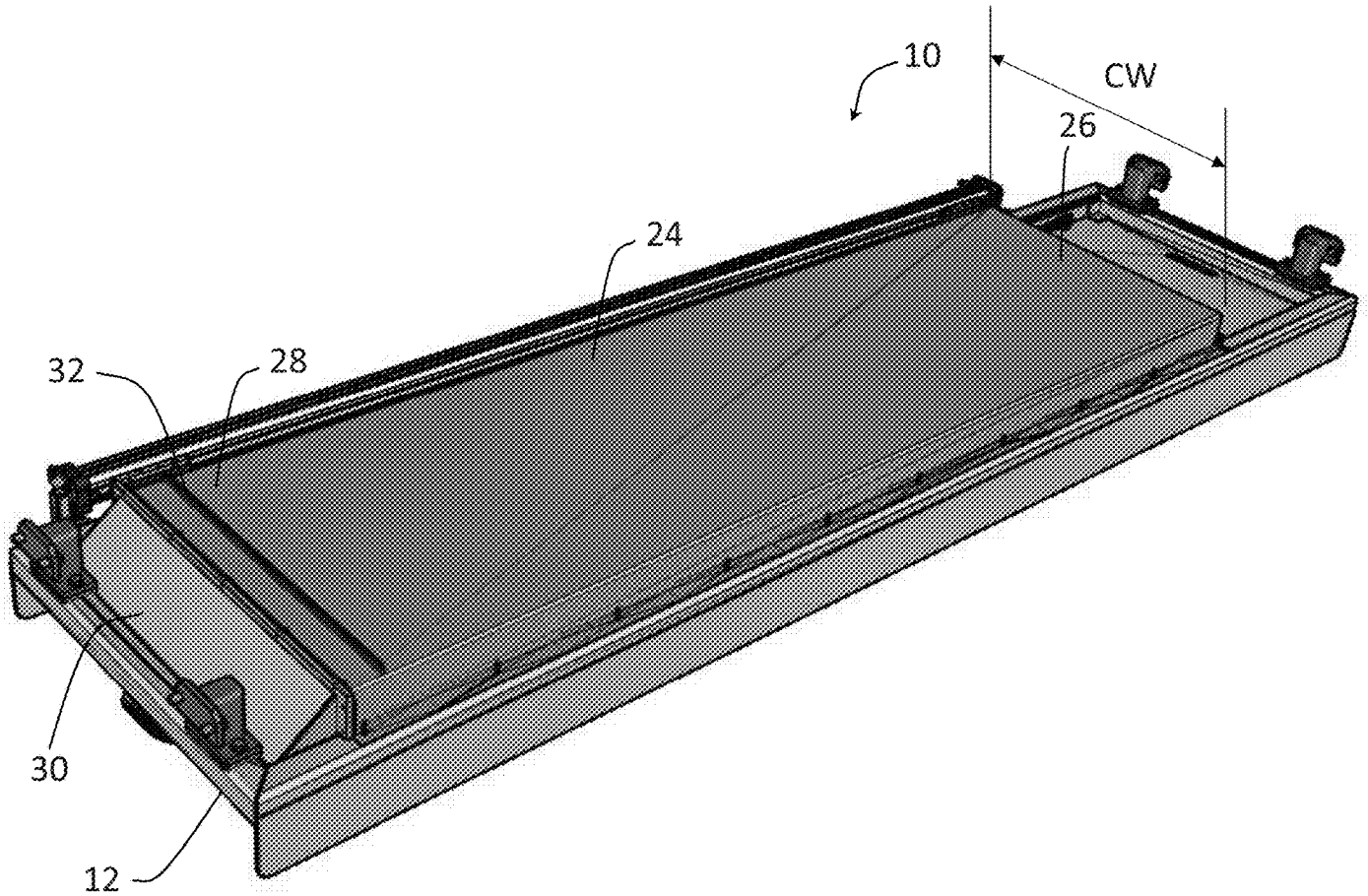
FIG. 3 is a perspective, bottom view of a dust control platform.

FIGS. 1-3 illustrate a dust control platform 10. The dust control platform 10 may include an accumulation surface 12. The accumulation surface 12 may include a first surface 14 and a second surface 16, opposite the first surface 14. The accumulation surface 12 may be any substantially flat surface that may collect dust. The accumulation surface 12 may be positioned horizontally or at a surface angle $\alpha$. In some embodiments, the surface angle $\alpha$ may be from about 1 degrees to about 60 degrees from the horizontal axis 13 to the first surface 14 of the accumulation surface 12, such as illustrated in FIG. 2A. It is to be appreciated that the surface angle $\alpha$ may be measured from the horizontal axis 13 to the external surface of the dust control platform 10. The accumulation surface 12 may include a plurality of apertures 18. The plurality of apertures extend through the accumulation surface 12, from the first surface 14 to the second surface of the accumulation surface 12. Each aperture 18 may be sized such that the particulate material, such as dust, generated by the web may pass through the apertures. The plurality of apertures may be the same and/or different sizes. Similarly, the apertures may be any shape such that the particulate material, such as dust, may pass through the apertures. For example, the apertures may be circular, square, rectangular, and/or oval.

The accumulation surface 12 may include a first end portion 20 and a second end portion 22, opposite the first end portion 20. The plurality of apertures 18 may extend from the first end portion 20 to the second end portion 22. The accumulation surface 12 includes an accumulation surface width SW. The accumulation surface width SW may be wide enough such that the accumulation surface 12 may be used as a walkway, such as for manufacturing personnel. The accumulation surface width SW may be any width that is sufficient to collect particles dispersed from the traversing web. The accumulation surface 12 may also include an accumulation surface length SL extending perpendicular to the accumulation surface width SW. The accumulation surface length SL may be any length sufficient to collect particles dispersed from the traversing web. In some embodiments, the accumulation surface length SL may be less than, greater than, or equal to the width of the traversing web.

The dust control platform 10 may also include an accumulation chamber 24 positioned adjacent the accumulation surface 12. More specifically, the accumulation chamber 24 may be positioned adjacent the second surface 16 of the accumulation surface 12. The accumulation chamber 24 may be positioned such that the particles that are captured and transferred through the accumulation surface 12 are deposited and held in the accumulation chamber 24. The accumulation chamber 24 may be sized such that all of or a portion of the plurality of apertures 18 are surrounded by the accumulation chamber 24. The accumulation chamber 24 may include a first end portion 26 and a second end portion 28, opposite the first end portion 26. The accumulation chamber 24 may include an accumulation chamber length CL, extending from the first end portion 26 to the second end portion 28. The accumulation chamber length CL may be greater than, less than, or equal to the accumulation surface length SL. Further, the accumulation chamber 24 may include an accumulation chamber width CW. The accumulation chamber width CW may be greater than, less than, or equal to the accumulation surface width SW.

As illustrated in FIGS. 1 and 3, a collection chamber 30 may be positioned adjacent the second end portion 28 of the accumulation chamber 24. The collection chamber 30 may be used as an area to collect the particles that have accumulated in the accumulation chamber 24. The collection chamber 30 may be operatively connected to a vacuum source. The vacuum source may be an individual vacuum source connected to the collection chamber 30 or the vacuum source may be a central vacuum source that supplies vacuum to two or more devices. The vacuum source may be continuously activated such that vacuum is continuously supplied to the accumulation chamber 24 or the vacuum source may be intermittently activated such that vacuum is supplied at designated at times and for designated time periods. The vacuum source may be manually and/or automatically operated.

Figure 4:
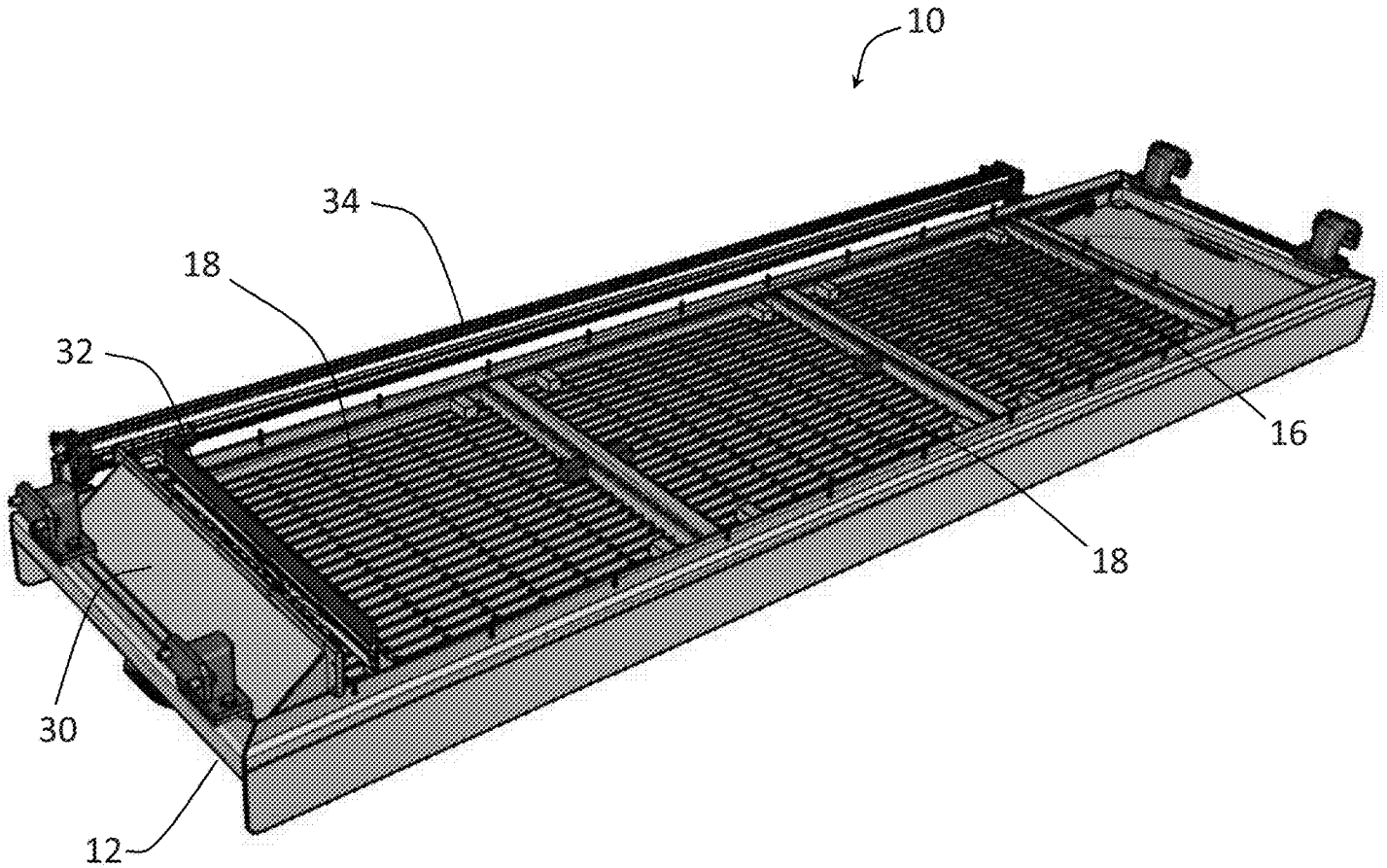
FIG. 4 is a perspective, bottom view of a portion of a dust control platform.
Figure 5:
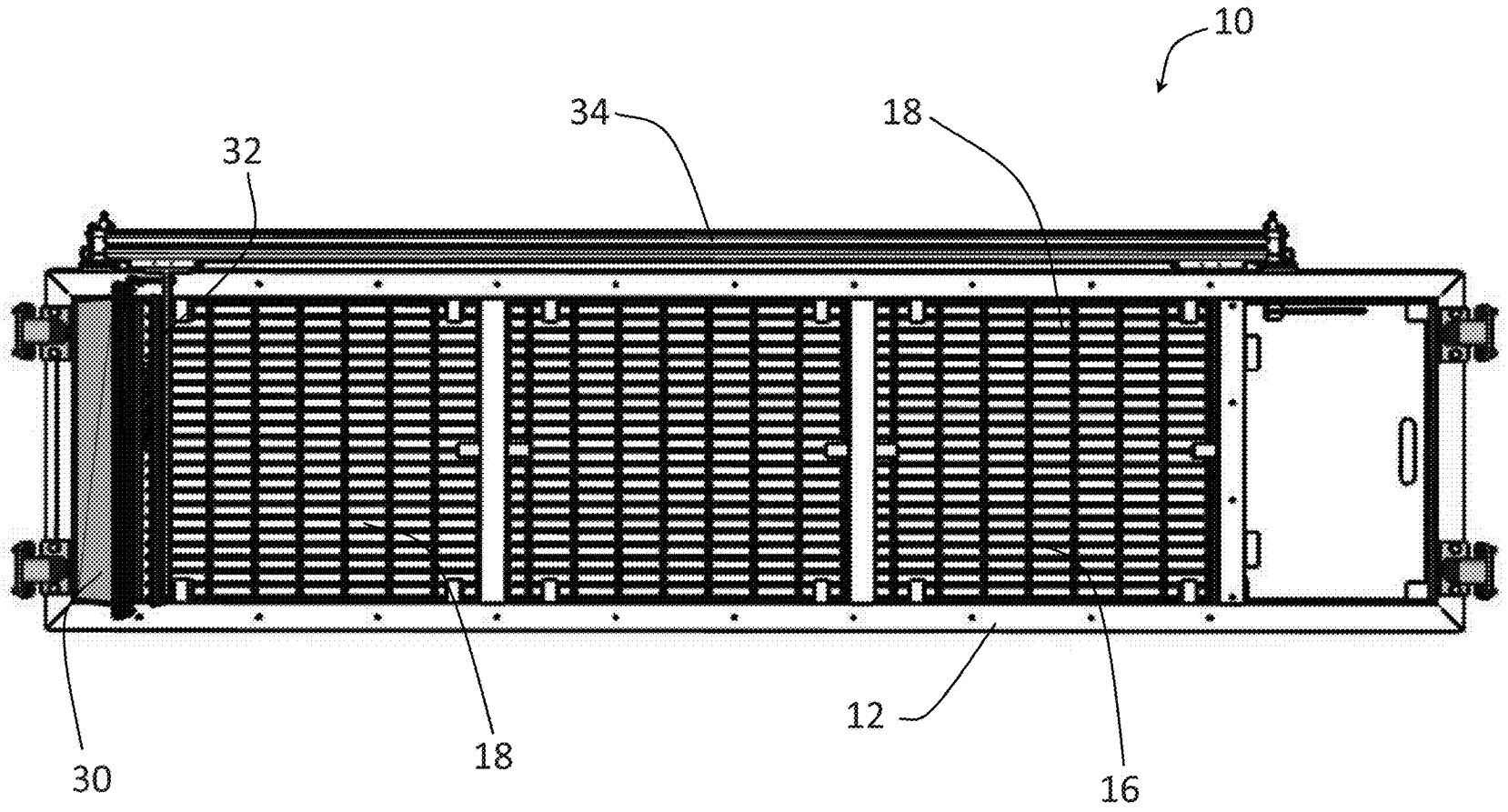
FIG. 5 is a bottom view of a portion of a dust control platform.

Referring to FIGS. 3-5, a sweeping device 32 may be disposed within the accumulation chamber 24 such that a portion of the sweeping device 32 engages the bottom surface of the accumulation chamber 24. The sweeping device 32 may include a brush, fin, or any other device that causes movement of the accumulated particles. The sweeping device 32 extends in a direction substantially parallel to the accumulation chamber width CW. Further, the sweeping device 32 substantially covers the accumulation chamber width CW such that substantially all of the particles are moved from the accumulation chamber 24 into the collection chamber 30. The sweeping device 32 may be operatively connected to a guide member 34. The guide member 34 may be disposed along a side edge of the accumulation chamber 24 and/or the accumulation surface 12. The guide member 34 may include a rigid, guide rail that extends from the first end portion 26 to the second end portion 28 of the accumulation chamber 24. The guide member 34 may be used to guide the sweeping device 32 from the first end portion 26 to the second end portion 28 of the accumulation chamber 24. More specifically, the sweeping device 32 may be positioned adjacent to the first end portion 26, opposite the collection chamber 30, of the accumulation chamber 24 while particles accumulate in the accumulation chamber 24. After a certain period in time or once a certain amount of particles have accumulated in the accumulation chamber 24, the guide member 34 guides the sweeping device 32 from the first end portion 26 to the second end portion 28, towards the collection chamber 30. The particles are carried by the sweeping device across the accumulation chamber 34 and are deposited in the collection chamber 30. As previously discussed, vacuum may be supplied to the collection chamber 30 and the particles may be removed from the collection chamber 30 by a vacuum source.

The sweeping device 32 may be operatively connected to a drive member. The drive member may be a motor. The motor may be any device that transmits energy to the dust control platform. The motor may be operatively linked or operatively engaged with the sweeping device using any technique known to those skilled in the art such as, for example, a gear to gear connection, transmission belting and pulleys, gearboxes, direct couplings, and the like or any combination thereof. It is to be appreciated that the drive member may also include a pneumatic cylinder or a hydraulic cylinder. It is also to be appreciated that the sweeping device may be moved manually from the first end portion 26 to the second end portion 28 of the accumulation chamber 24.

Figure 6:
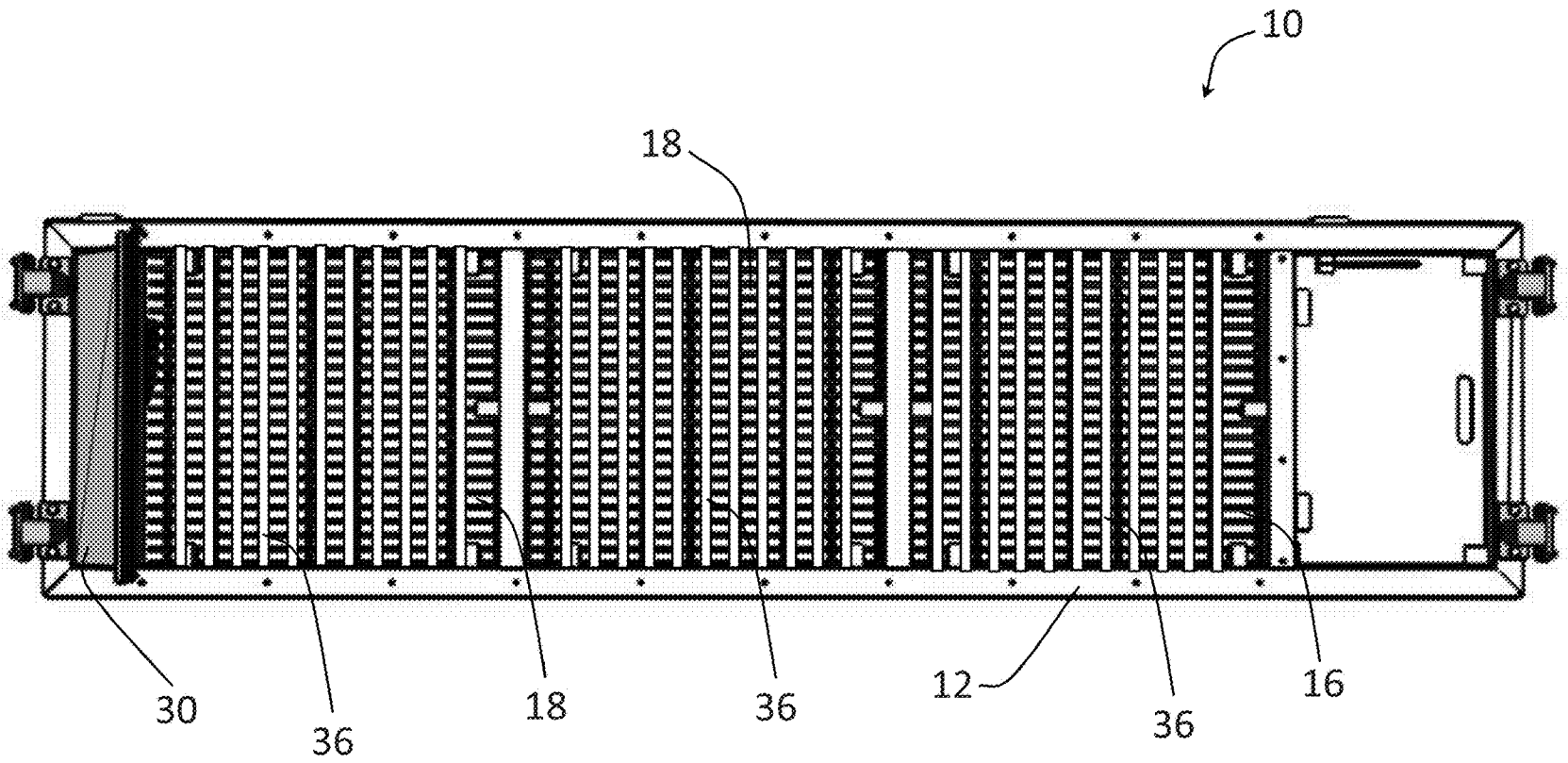
FIG. 6 is a bottom view of a portion of a dust control platform.

In some embodiments, the dust control platform 10 may include a plurality of vanes 36 positioned adjacent the second surface 16 of the accumulation surface 12, as illustrated in FIG. 6. Each of the plurality of vanes may be positioned along the second surface 16 of the accumulation surface and each may extend in a direction substantially parallel to the accumulation surface width SW. The plurality of vanes may move from a position where a vane surface is substantially perpendicular to the second surface 16 of the accumulation surface 12 to a position where the vane surface is substantially parallel to the second surface 16 of the accumulation surface 12. When the vanes are in an open positioned, also referred to herein as an open configuration, such that the vane surface is substantially perpendicular to the second surface 16 of the accumulation surface 12, the particles may pass through the plurality of apertures 18 defined by the accumulation surface 12. When the vanes are in a closed positioned, also referred to herein as a closed configuration, such that the vane surface is substantially parallel to the second surface 16 of the accumulation surface 12, the vanes cover the plurality of apertures and the particles are no longer able to pass through the plurality of apertures 18. The vanes may cover the plurality of apertures, which creates a substantially enclosed area to which vacuum may be applied. More specifically, with the vanes in the closed positioned, the accumulation chamber 24 in combination with the vanes in the closed positioned forms a substantially enclosed area such that some external fluid, such as air, may enter the area while the area is substantially enclosed. Vacuum may then be supplied to this area causing the particles to be removed from the accumulation chamber 24. The enclosed area created by the vanes in the closed position increases the effectiveness of the vacuum. The vanes may be rotated from the open position to the closed position and vice versa manually or automatically, such as by a drive member as previously described. The drive member activates the vanes to move to various positions.

In some embodiments, the dust control platform 10 may not include an accumulation surface 12. Rather, the plurality of vanes 36 may act as an external surface in the closed position. The plurality of vanes 36 may operate as previously described. The plurality of vanes 36 in the closed position may also act as a walking surface for manufacturing operators. The plurality of vanes 36 may be manually or automatically controlled such that they are rotated to the closed position when a walking surface is needed.

Figure 7:
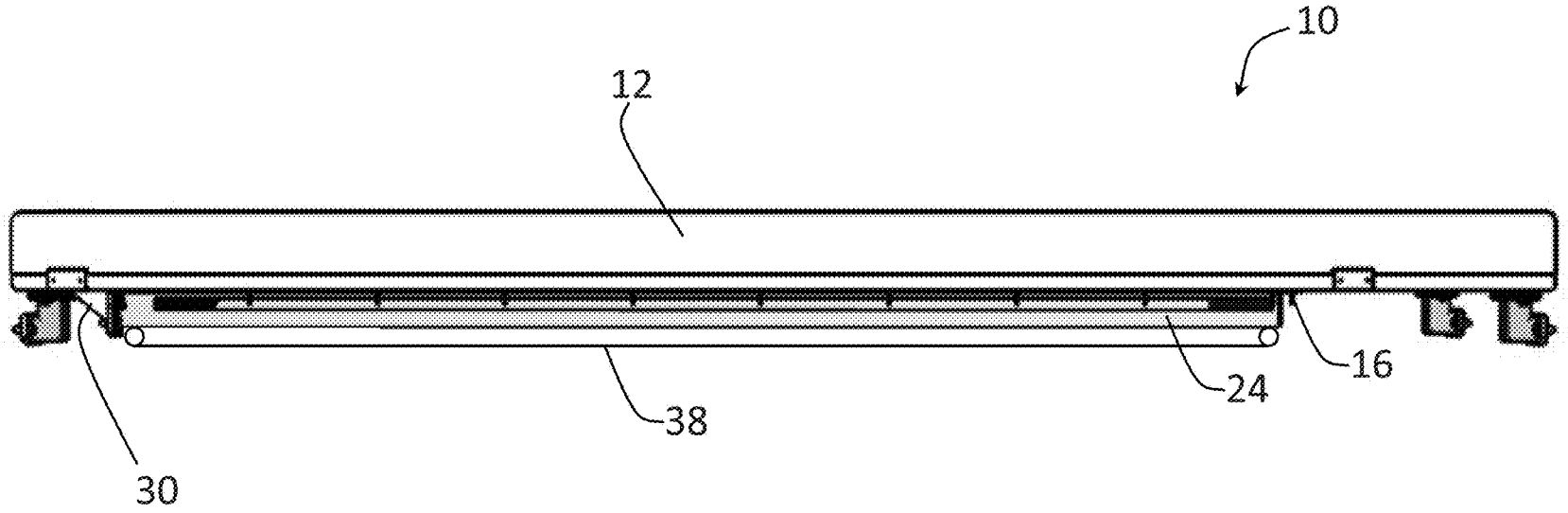
FIG. 7 is a side view of a dust control platform.

In some embodiments, as illustrated in FIG. 7, one or more conveyors 38 may be used to transfer the particles, such as dust, from the accumulation chamber 24 into the collection chamber 30. One or more conveyors may be positioned adjacent the bottom surface or may serve as the bottom surface of the accumulation chamber 24. The particles may accumulate on the surface of the conveyor 38, and the conveyor 38 may advance such that the particles that accumulate on the surface are transferred to the collection chamber 30. Vacuum and/or additional mechanical devices may be used to aid in transferring the particles from the conveyor surface to the collection chamber 30. Each of the one or more conveyors 38 may include a belt, chain, or other surface which is capable of catching particles that traverses about one or more rollers. The conveyor may be activated by the drive member, such as previously described.

Figure 8:
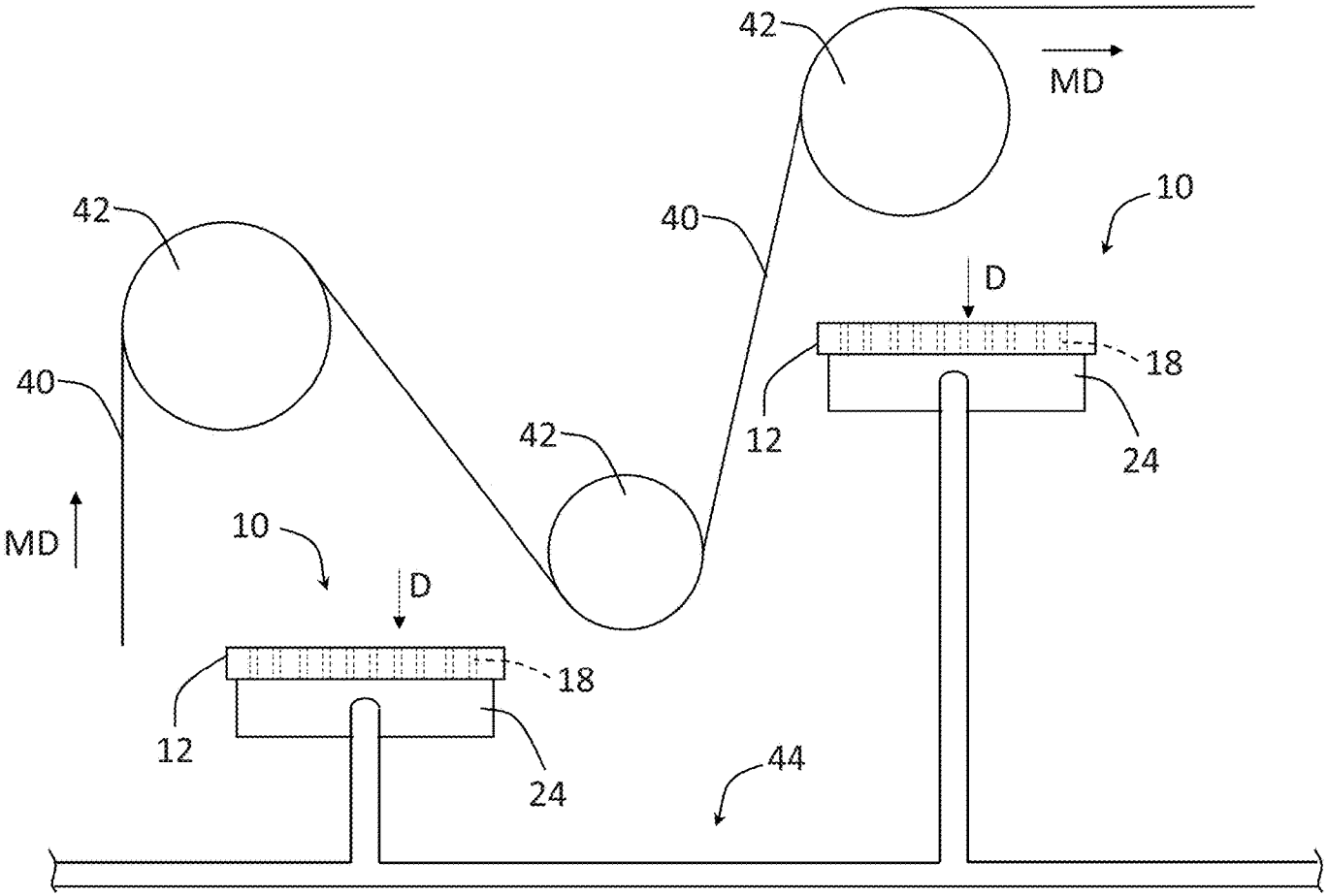
FIG. 8 is a schematic representation of a portion of a manufacturing line including one or more dust control platforms.

Referring to FIG. 8, the disclosed apparatus may be used in the method of controlling particles, such as dust, generated from a moving web 40. The web 40 traverses in a machine direction MD through various processes. As illustrated, for example, the web 40 may traverse about various rollers 42 where one or more processes may take place or the web may be directed in various directions to additional processes. As the web 40 traverses and processes are performed on the web 40 particles, such as dust, may be generated by the web 40. The particles, as previously discussed, may interfere with the processing of the web and may become a hazard to those working in the vicinity of the web. Thus, one or more dust control platforms 10 may be provided.

The dust control platforms 10 may be positioned adjacent the traversing web such that the dust control platforms 10 are positioned in areas of relatively high particle generation but do not interfere with the traversing web 40 and the other manufacturing operations. The particles, such as dust, pass through the plurality of apertures 18 defined by the accumulation surface 12, as illustrated in FIG. 8 by arrow D. The particles flow through the accumulation surface 12 and into the accumulation chamber 24. The particles that have accumulated in the accumulation chamber 24 may then be gathered by the sweeping device 32 disposed within the accumulation chamber 24. The sweeping device 32 may be activated such that the sweeping device 32 traverses from the first end portion 26 to the second end portion 28 of the accumulation chamber 24 causing the particles to be collected in the collection chamber 30. A vacuum source 44 may be operatively connected to the collection chamber 30. The particles that have been deposited in the collection chamber 30 may be removed from the collection chamber 30 by the vacuum source 44. It is to be appreciated that a drive member may be configured to activate the sweeping device such that the sweeping device moves along the accumulation chamber 24. Further the sweeping device may be periodically, automatically activated and/or manually activated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling dust from a moving web, the method comprising:

traversing a web in a machine direction, wherein the traversing web generates dust;

providing a dust control platform positioned adjacent the web, wherein the dust control platform comprises:

an accumulation surface, wherein the accumulation surface comprises a plurality of apertures extending through the accumulation surface, and wherein the accumulation surface comprises an external surface and an internal surface;

an accumulation chamber positioned adjacent the accumulation surface, wherein the accumulation chamber comprises a first end portion and a second end portion;

a collection chamber positioned adjacent the second end portion of the accumulation chamber;

a plurality of vanes positioned adjacent the internal surface of the accumulation surface;

a drive member operatively engaged with the plurality of vanes;

wherein the dust generated by the traversing web passes through the apertures of the accumulation surface of the dust control platform;

accumulating the dust in the collection chamber;

activating the plurality of vanes such that the plurality of vanes are positioned in a closed configuration;

activating a vacuum source operatively connected to the accumulation chamber; and removing the dust from the accumulation chamber.

2. The method of claim 1, comprising rotating the plurality of vanes to an open configuration.

3. The method of claim 1, wherein the accumulation chamber comprises a conveyor positioned adjacent the internal surface of the accumulation surface, and wherein the conveyor is configured to advance the dust to the collection chamber.

4. The method of claim 1, wherein the drive member is periodically, automatically activated.

5. The method of claim 1, wherein the plurality of vanes substantially cover the plurality of apertures in the closed configuration.

6. The method of claim 1, wherein the drive member comprises a pneumatic cylinder.

* * * * *